US006325493B1

(12) United States Patent
Yamaguchi

(10) Patent No.: US 6,325,493 B1
(45) Date of Patent: Dec. 4, 2001

(54) LIQUID DISCHARGE RECORDING HEAD

(75) Inventor: Yukuo Yamaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/597,149

(22) Filed: Jun. 20, 2000

(30) Foreign Application Priority Data

Jun. 21, 1999 (JP) ..... 11-174421

(51) Int. Cl.[7] ..... B41J 2/05
(52) U.S. Cl. ..... 347/65; 347/63
(58) Field of Search ..... 347/20, 44, 47, 347/54, 56, 63, 65; 29/890.1; 216/27; 430/320; 425/588

(56) References Cited

U.S. PATENT DOCUMENTS 5,255,022 * 10/1993 Burolla ..... 347/85
5,537,133 * 7/1996 Marler et al. ..... 347/18
6,106,096 * 8/2000 Komplin et al. ..... 347/20

FOREIGN PATENT DOCUMENTS

2000334957-A * 12/2000 (JP) ..... B41J/2/05
8230195-A * 9/1996 (JP) ..... B41J/2/135

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

A liquid discharge recording head having a ceiling plate member which includes a first substrate having a portion including at least the circumference of discharge ports of ink flow paths and an orifice plate and a second substrate having portions not included in the first substrate. The first substrate and the second substrate are bonded to be integrally formed by bicolor molding and at the same time an insert member is arranged on the boundary surface between the second substrate and first substrate.

11 Claims, 8 Drawing Sheets

LIQUID DISCHARGE RECORDING HEAD

BACKGROUND OF THE INVENTION

1. Field of the Invention

The present invention relates to a liquid discharge recording head used for a liquid discharge recording apparatus that records on a recording sheet by discharging ink from the discharge ports of an orifice plate. More particularly, the invention relates to a liquid discharge recording head the moldability of which is designed to be enhanced.

2. Related Background Art

The liquid discharge recording apparatus is the one that records on a recording sheet by discharging ink (recording liquid) as liquid droplets from the discharge ports of an orifice plate provided for a liquid discharge recording head. In accordance with the driving signals transmitted from the main body of the liquid discharge recording apparatus, ink is heated in each of the liquid flow paths by means of the discharge energy generating elements arranged in the liquid flow paths, respectively, thus making the change of states in ink to create bubbles. Then, with the voluminal changes at the time of bubbling, ink is discharged from the respective discharge ports.

More specifically, as discharge energy generating elements, the electrothermal transducing elements are used, which provide heating when energized in accordance with recording signals. The discharge energy generating elements are formed by the application of the thin film formation technologies and techniques which have been developed in the semiconductor field.

Generally, the liquid discharge recording head comprises a substrate having a plurality of discharge energy generating elements arranged thereon, and a ceiling plate that covers the upper portion of the substrate. The ceiling plate comprises liquid flow paths (nozzles) each corresponding to each of the discharge energy generating elements on the substrate; an orifice plate having ink discharge ports thereon; an ink liquid chamber to supply ink to each of the liquid flow paths; and an ink supply port through which ink is supplied to the ink liquid chamber.

The orifice plate is a sheet member having a thickness of several tens of $\mu$m to several hundreds of $\mu$m. Then, many numbers of precise holes are formed on this sheet member as ink discharge ports. As a method for forming the fine holes efficiently in high precision, a laser processing, an electrocasting, a precise press work, or a precise molding is utilized, among some others.

On the other hand, each of the liquid flow paths (nozzles) is formed by a groove having a width of several tens of $\mu$m, and a depth of several tens of $\mu$m. Many numbers of such grooves are arranged at pitches of several tens of $\mu$m. In order to arrange them in high precision to face each of the discharge energy generating elements, these fine grooves are produced by an injection molding, a transfer molding, a compression molding, an extrusion molding, a casing, a ceramics injection, or the like, or the excimer laser, the YAG laser or some other micro-laser process, or silicon anisotropic etching, photolithography, or some other semiconductor thin film formation techniques.

The ceiling plate may be formed by means of any one of those precise processing methods described above, but the precise molding method is, in particular, extremely effective in that the required members can be produced at lower costs, and that even a complicated shape can be molded with ease. Therefore, it has been possible to mold a ceiling plate in various modes up to now.

As the molding resin material, there is in use polysulfone, polyether sulfone, polyphenylene sulfide, modified polyphenylene oxide, polypropylene, polyimide, liquid crystal polymer (LCP), or some other resin material with excellent resistance to ink.

When molding a ceiling plate, the most difficult process is to fill up the thinner portions of the orifice plate, and transfer the extremely small portions of the liquid flow path walls. Therefore, the ceiling plate should be molded in high precision by the application of various simulation techniques, such as flowability analysis, while freely using precise die machining techniques, a high speed injection molder for precision processing, as well as by use of a highly flowable resin material.

Here, the orifice plate is either molded together with the ceiling plate or molded separately from the ceiling plate. The structure of the ceiling plate is, in either case, selected appropriately depending on the component structures as a whole, the structure of the assembling systems, the method of laser processing, or the like. In any case, however, a highly precise molding art should be adopted.

FIG. 8 is a view which schematically shows the conventional liquid discharge recording head of the kind. As shown in FIG. 8. the liquid discharge recording head comprises the substrate (hereinafter referred to as a heater board) 100 provided with ink discharge pressure generating elements, the ceiling plate 500 having concave and convex portions, which is bonded to the heater board 100 to form the ink liquid chamber 600 and liquid flow paths (nozzles) 700 that contain recording liquid (hereinafter referred to as ink). On the upper portion of the ink liquid chamber 600, the ink supply port 1000 is arranged to be communicated with the ink liquid chamber 600.

Also, in front of the liquid flow paths (nozzles) 700, the orifice plate 400, which is provided with the ink discharge ports for discharging ink, is formed together with the ceiling plate 500 or bonded to or coupled with the ceiling plate 500. Thus, the ink discharge ports are communicated with the liquid flow paths 700.

The heater board 100 is adhesively fixed to a supporting substrate (hereinafter referred to as a base plate) 300 by the application of a bonding agent 306 or the like. The ceiling plate 500 is positioned and bonded to the heater board 100 in such a manner that the heater unit 100*a* that serves as ink discharge energy generating elements arranged thereon is in agreement with the liquid flow paths (nozzles) 700 of the ceiling plate 500. Then, the orifice plate 400 is arranged for the front end of the base plate 300 like an apron. Also, the ink liquid chamber 600 of the ceiling plate 500 receives ink from an ink tank (not shown) through the ink supply port 1000.

If bonding agent, such as sealant or adhesives, is applied to bonding the liquid flow paths (nozzles) 700 and the heater board 100. When the ink flow paths are formed for the liquid discharge recording head of the kind by bonding the liquid flow paths (nozzles) 700 with the heater board 100 together, the bonding agent tends to flow into the liquid flow paths (nozzles) 700, and there is a possibility that the shape of the liquid flow paths (nozzles) 700 is changed or the liquid flow paths (nozzles) 700 are partly clogged. Therefore, at least the wall portion of the liquid flow paths should be bonded under pressure mechanically exerted.

Hereunder, the structure of such portion will be described. The heater board 100 and the ceiling plate 500 are positioned in the direction (indicated by an arrow E) which is in parallel to the ink discharge direction. The heater board 100 and the ceiling plate 500 are bonded, while the front end of the heater board 100 is allowed to abut against the orifice plate 400. Then, the nails 507 of a pressure spring 900, which are provided on the lower parts on both edges thereof, are inserted into the holes 307 arranged for the base plate 300, respectively. Thus, the folded portions 507*a* of the nails 507 are hooked on the lower face of the base plate 300. In this manner, the pressure spring 900 exerts mechanical pressure to the contacted portions from above the liquid flow path walls of the ceiling plate 500.

In this manner, consequently, the liquid flow path walls of the ceiling palate 500 and the heater board 100 are closely in contact under mechanical pressure thus exerted.

Nevertheless, with the mechanical pressure of the kind, a load is given to the liquid flow path walls directly from above, and although the heater board 100 is sufficiently in contact, the pressure is not exerted good enough on the bonded portions, such as the outer walls portions of the ink liquid chamber 600, and some others. As a result, it becomes extremely difficult to press and keep all of them closely in contact with the heater board 100 exactly.

In contrast, there is a method in which pressure means are provided individually so that the outer wall portion of the ink liquid chamber is in close contact. However, if the outer wall portion of the ink liquid chamber is pressed using this method, the repulsion that should be exerted thereby tends to act upon the liquid flow path walls to impede the close contact of the liquid flow paths walls. Therefore, this method can hardly regarded as the one that may produce good effect after all.

Under the circumstances, it is generally practiced to provide a small step between the lower face of the liquid flow path walls and the lower face of the ink liquid chamber outer wall portion in order to form a gap between the lower face of the ink liquid chamber outer wall portion and the heater board 100 when the lower face of the liquid flow path walls and the heater board 100 are closely in contact. Then, sealant is applied, which is arranged to flow into this gap to provide the airtightness securely between the ink liquid chamber outer walls and the heater board 100.

Here, of course, the defective sealing may be caused if such gap is too large. On the other hand, if such gap is too small, the lower face of the ink liquid chamber outer walls is in contact with the heater board 100, thus impeding the close contact between the liquid flow path walls and the heater board 100 eventually.

Therefore, the molding process should be controlled so that the step between the lower face of the liquid flow path walls and the lower face of the ink liquid chamber outer walls is formed in an appropriate size in order to allow the sealant to flow exactly into the gap formed between the lower face of the ink liquid chamber outer walls and the heater board 100.

The sealant is also used for the portions other than the aforesaid gap between the ink liquid chamber outer walls and the heater board 100. The sealant is used for all the contacted portions that should be in contact with ink so as not to allow ink to leak to the outside. More specifically, the sealant is used for the contacted portions between the back face of the orifice plate 400 and the front face of the heater board 100, between the back face of the orifice plate 400 and the front end of the base plate 300, and between the ceiling plate 500 and the heater board 100, among some others. The sealing of each of these gaps is carried out by enabling the sealant to flow into a specific range by the application of the capillary force that may be generated between each gap of the respective members and the sealant, while the configuration of each member is devised so that the sealant is not allowed to flow into any portions outside such specific range, and each dimension of the parts and the viscosity of the sealant should be controlled appropriately, among some others required for the intended sealing.

FIG. 9 is a cross-sectional view which shows the bonded state between the ceiling plate 500 and the heater board 100. As shown in FIG. 9, the pitches of the liquid flow paths (nozzles) 700 of the ceiling plate 500 and those of the heater portions 100*a* on the heater board 100 are set equally, and the machining of each part and the positioning between them are carried out in high precision to enable each of the liquid flow paths (nozzles) 700 and each of the heater portions 100*a* to face each other accurately for the enhancement of the precision of ink discharges.

Also, if part of ink should drop and flow when ink is discharged from the liquid discharge recording head so that it is allowed to adhere to the circumference of the discharge ports, the direction of ink discharges is forced to deviate or ink clogging may take place if the ink adhesion is left intact for a long time and solidified. Generally, therefore, a water repellent treatment is given to the entire surface of the orifice plate or a part of the circumference of the ink discharge ports in order to prevent ink from residing on the circumference of the ink discharge ports. Here, after the ceiling plate has been formed, a water repellent treatment of the kind is performed by the injection, coating, or eutectoid plating of the water repellent agent to the surface of the ceiling plate.

As described above, the ceiling plate is formed in a complicated shape having small portions and thinner portions, which is produced integrally with the liquid flow path walls, the orifice plate, the ink liquid chamber, the ink supply port, and the like. In order to form the ceiling plate, therefore, it is required to make thorough control on the molding environment, molding condition, material quality, and some others. There are a number of requirements that should be met, such as the dimensional accuracy, dimensional stability, transfer precision, micro-deformation, and others, as well as the performance of filling the precisely formed portions, the thinner portions, and the like. With these in view, it is not easy to provide finished products stably.

The most rigid precision is needed for the flatness of the lower face of the liquid flow path walls of the finished ceiling plate. Usually, however, warping of approximately several $\mu$m may occur on the lower face of the liquid flow path walls of the ceiling plate. Therefore, the lower face of the liquid flow path walls is kept closely in contact with the heater board, while pressing the upper portion of the liquid flow path walls downward by means of the pressure spring, thus correcting such warping of the lower face of the liquid flow path walls. Here, the orifice plate is then affected to be warped following the influence exerted by the distortion of the circumference of the liquid flow path walls, and by the influence of the warping of the orifice plate as well. There is a fear then that the relative directions or the relative positions of the discharge ports arranged in plural numbers are caused to change. Thus, consequently, inner stress or inner distortion may take place on the ceiling plate which is closely in contact with the heater board, making the impact accuracy of ink degraded to affect the quality of prints accordingly.

To counteract the occurrence of this event, there is a method in which the ceiling plate is formed with a material having a larger elastic modulus to improve the rigidity of the ceiling plate, hence making the inner distortion smaller when it is in close contact with the heater board. However, if the rigidity of the ceiling plate is made greater, it becomes difficult to correct the warping of the lower face of the liquid flow path walls. There is a fear to follow that its contact with the heater board becomes defective. There is also a method in which the pressure of the pressure spring is made greater to regulate the entire region of the liquid flow path walls correctly. In this method, however, if the pressure is made greater, the inner stress of the ceiling plate is increased accordingly, which results in still greater inner distortion after all.

If the contact between the liquid flow path walls and the heater board is not good enough, a gap with the heater board is created inevitably on the adjacent liquid flow path walls themselves, among those liquid flow paths, which have been formed by bonding the heater board and the liquid flow path walls. Then, the ink discharges become unstable when recording is made. Ink droplets may be twisted. Also, when recording signals are applied, ink is not discharged from the discharge port from which it is intended to be discharged. Ink may be discharged from the adjacent discharge port with the result that recorded prints are disturbed, hence inviting the degradation of the recorded image in some cases.

With these in view, there is a need for overcoming the conventionally existing problems related to the ceiling plate when developing a liquid discharge recording apparatus which should be capable of recording images in higher quality. More specifically, surface precision of the lower face of the liquid flow path walls should be made better than that of the conventional one. Moreover, then, the rigidity of the ceiling plate should be made greater. Only when these requirements are fulfilled, it becomes possible to minimize the inner distortion which should be created by its close contact with the heater board.

Meanwhile, the selection of the material which is excellent in the stability of providing highly precise dimensions is indispensably important to raise the technical level when forming precisely thinner film. Also, in order to overcome the weakness of the ceiling plate, there is automatically a limit in molding by use of the pure material which does not contain any fillers as conventionally practiced. Therefore, there is a need for use of the molding material whose physical property is made stronger with the provision of fillers, such as ceramics, metals, when molding a ceiling.

However, when molding the ceiling plate with resin that contains fillers one may encounter the following problems.

At first, there is a problem related to the laser processing. When the orifice plate is formed with resin, the precise holes provided therefor are generally made by the ablation using the excimer laser. However, the excimer laser processing is not effective in making ablation on the filler portions. Then, there is a fear that on the inner surface of each precise hole, fillers are allowed to remain as extrusions or fillers may fall off from the inner surface to form recessed portions. Consequently, the inner surface of each precise hole is not formed smoothly, and the defective ink discharges may ensue eventually.

Secondly, there is a problem related to the manufacture of metallic molds. Since the liquid flow path walls of the ceiling plate are in extremely precise configuration, the die dwell that transfers these portions should be processed accurately in higher precision. Also, it is not easy to machine the die dwell by use of general machine tools. Therefore, a specially built machine tool is needed to machine it accurately using a specially prepared material. It also takes a long time to complete such machining. Thus, the manufacture of the die dwell for the transfer use of the liquid flow path walls makes the manufacturing costs of the metallic die expensive. Further, in the molding process, there is friction caused between the fused resin and the die dwell at the time of injection. The die dwell slidably moves on the finished product when the die is released. Therefore, if the material of the ceiling plate contains fillers or the like, the die dwell is worn down quickly to affect the durability of the metallic die. Then, the productivity of the ceiling plates is lowered accordingly.

Thirdly, there is a flowability problem of materials. For the formation of a ceiling plate, the material grade is selected so that it has a good flowability, because small portions should be transferred exactly. Generally, however, if resin contains fillers, its flowability is degraded, presenting disadvantage in transferring thinner thickness portions or small portions.

Fourthly, a problem is encountered that fillers impede the flowability and transferability of resin. The width of each liquid flow path wall is as fine as several $\mu$m to ten and several $\mu$m, and there is a possibility that the grain dimension of a filler, such as fibre, bead, becomes larger than the thickness of each liquid flow path wall. If the ceiling plate is molded by resin containing fillers, not only the fillers are not transferred into the liquid flow path walls, but also, fillers may reside on the entrance of each groove portion in the state where each of them is bridged at the entrance to block the flow of fused resin that follows it or to disturb the flow of resin. Also, if the molding is made using the resin that contains fillers, there is a possibility that fillers are educed to the surface layer of a finished product in some cases. Then, the educed fillers on the surface are rubbed by the metallic die when released, and the fillers may fall off from the surface layer of the finished product. Here, the fillers are not filled in the liquid flow path wall portions, and the effect of the improved performance is not obtainable as anticipated after all.

To counteract this, it may be possible to form the ceiling plate with the resin that contains ultrafine filler powder of several $\mu$m or several nm, which is smaller than the thickness of each liquid flow path wall. However, it is extremely difficult to disperse such ultrafine filler powder uniformly in the base resin. It is thus extremely difficult to expect the stable supply of the desired material.

Here, not only the application of a special technique is needed in order to implement the uniform dispersion of ultrafine filler powder in the base resin, but also, the surface treatment is needed for the ultrafine filler powder by use of silane coupling agent or the like. Therefore, the resin material that contains the ultrafine filler powder of the kind becomes very expensive inevitably.

As described above, although it is possible to enhance the molding precision of the ceiling plate by making its physical property stronger with the filling of fillers thus prepared, this means is not necessarily considered effective, because the fillers may impede the laser processing, the quality of the molded product is degraded, the durability of the metallic die is affected, and the expensive molding material may present disadvantages itself, among some other drawback.

Therefore, with the conventional molding method, it is difficult to improve the molding precision of the ceiling plate, the surface precision of the lower face of the liquid flow path walls, the rigidity of the ceiling plate, and the like. To overcome this difficulty is a subject when developing a liquid discharge recording head having a higher density of the liquid flow path walls.

Now, the description will be made of the problems encountered in the environment of a liquid discharge recording head during use, and also, in the environment under which it should be stored.

If the temperature of the environment changes greatly, each individual part of a liquid discharge recording head in use is caused to present a voluminal expansion or a voluminal contraction, which may, in some cases, displace the relative positions of the bonded portions of the head. The liquid flow path walls formed by the close contact between the ceiling plate and the heater board are in an extremely small shape, such as having its pitches at several tens of $\mu$m. As a result, if the relative positions of both members is displaced greatly, an unfavorable influence is produced on the performance of ink discharges.

Also, since the materials of the members that constitute the heater board, and those of the ceiling plate are different, forces are exerted, which tend to displace the relative positions of the heater board and the ceiling plate. In other words, the heater board and the ceiling plate present the voluminal changes each individually by the inner stresses that may be caused by the thermal expansion corresponding to the temperature changes. As a result, the liquid flow path walls and heaters which are bonded face to face are subjected to the displacement of relative positions between them.

On the other hand, the liquid flow path walls are mechanically pressed as described earlier, and with this pressure, frictional force is exerted between the liquid flow path walls and the heater board. By the presence of this frictional force, together with the mechanical strength of the liquid flow path walls themselves, the displacement of the relative positions is blocked between the liquid flow path walls and the heater board.

Nevertheless, the action of this mechanical pressure tends to become smaller on the leading end portion of each discharge port. Then, there is a fear that although extremely small, the displacement of relative positions occurs between the liquid flow path walls and the heater board at the leading end portion thereof.

Further, when nozzles are arranged in a higher density, the degree of influence thus exerted by the displacement of the relative positions becomes greater, and the displacement of the relative positions may take place not only on the leading end portion of each discharge port, but also, it may occur between the liquid flow path walls and the heater board as a whole. The displacement of the relative positions of the kind is not easily controlled. For example, with respect to a liquid discharge recording head having the discharge ports capable of obtaining a resolution of 1200 dpi per discharge, the width of the leading end of the liquid flow path wall is as small as 79 $\mu$m each in its dimension. The aforesaid friction force and the mechanical strain of the liquid flow path walls are made smaller accordingly.

In order to suppress the displacement of the relative positions, it may be possible to increase the pressure of the pressure spring so that the friction force is increased on the contacted surface of the liquid flow path walls. However, with this method of increasing the pressure of the pressure spring while allowing the ceiling plate to be in close contact, the inner distortion of the ceiling plate should become greater. Then, there is a fear that the quality of prints is degraded. Further, as described earlier, the liquid flow path walls receive the thermal stress at a high environmental temperature, as well as the load exerted by the pressure spring. As a result, the liquid flow path walls can no longer withstand the force thus exerted, buckling or plastic deformation caused by buckling may take place. Therefore, it is not advisable to increase the pressure of the pressure spring too much.

Also, as another method, it is conceivable to adopt the molding of the ceiling plate using resin having a smaller coefficient of linear expansion.

To make the coefficient of linear expansion of resin smaller, there is a method in which fillers, such as fiber or beads, are filled in resin. However, if the ceiling plate is molded with the resin material in which fillers are filled, its flowability is lowered, the durability of the metallic die is affected, the laser processability is deteriorated, and the material costs become higher as described earlier, although the coefficient of the linear expansion of the finished product is effectively made smaller. Therefore, this method cannot be regarded as effective means after all.

Further, as still another method, it may be possible to ease the thermal expansion of the liquid flow path walls by providing a member formed by material having lower thermal expansion which is inserted on the upper part of the liquid flow path walls.

As the low thermal expansion material, there is SUS, carbon steel, alloys, ceramics, silicon, filler-filled resin, or the like. The coefficient of linear expansion of each of these materials is considerably smaller than that of thermoplastic resin. Here, a member formed by some of those materials is arranged in the vicinity above the liquid flow paths in the arrangement direction of the liquid flow path walls. Then, an insertion molding is effectuated to integrate the insert member and resin on the circumference thereof together, thus making it possible for the insert member to physically block the thermal expansion of the liquid flow path walls.

However, since the insert member is provided above the liquid flow path walls, and structured to be buried in the ceiling plate, this member is held to be floating on the transfer surface of resin in the metallic die. As a result, the molding resin is separated on the circumference of the inserted portion, and should flow with the insert member between them. Thus, the flow of resin is disturbed in the vicinity of this insert member. This phenomenon brings about an extremely great pressure loss, and the filling performance of resin is affected accordingly. Then, the transferability is greatly impeded for the liquid flow path walls in the vicinity of the insert member after all.

Also, the ceiling plate is a small part, and in order to transfer resin to such a small part exactly for the molding of the ceiling plate, a high speed injection should be adopted for the intended injection molding. As a result, the insert member should be held firmly in the metallic die so that it can withstand such a severe molding process. However, as the insert member is a component which is smaller than the small ceiling plate, it is not easy to hold the insert member firmly with a desired strength.

Also, the structure is such that the insert member is buried in the vicinity above the liquid flow path walls. Therefore, not only the insert member cannot be held firmly in the metallic die, but also, the metallic die should be configured to be extremely complicated to satisfy such condition. Further, the contour of the supporting member that holds the insert member should be transferred to the finished product. Then, the excessive portion of the contour, which is considered completely useless for the function of the ceiling plate, should be molded additionally, thus restricting the design freedom of the ceiling plate to that extent.

With these in view, it is difficult to carry out the insertion molding by arranging the insert member in the vicinity above the liquid flow path walls as far as the molding mode of ceiling plate is monochromatic.

As has been described above, along with the higher resolution required for a liquid discharge recording head from now on, the selection of the resin material that may be preferably usable for the ceiling plate is inevitably limited to a considerable degree. Also, even with a material that may be applicable, its molding control becomes severer, thus making the enhancement of the molding precision more difficult.

SUMMARY OF THE INVENTION

Here, therefore, the present invention is designed with objectives to overcome the weakness of the performatory aspects, such as thermal expansion, rigidity, which is a problem encountered in the conventional art by improving the formability as a whole, such as the structure of the ceiling plate, the molding precision of the ceiling plate, the dimensional stability of the ceiling plate, in order to achieve the high resolution technologies and techniques of a liquid discharge recording apparatus to be used from now on. Then, it is an object of the invention to provide a liquid discharge recording head having nozzles in high density to be able to obtain high image quality, which is marketable at lower costs.

In order to achieve the objectives described above, the ink discharge recording head of the present invention comprises:

a substrate member having thereon a discharge energy generating element for giving discharge energy to ink corresponding to a plurality of ink flow paths arranged in parallel therefor;

a plurality of grooves corresponding to the plurality of ink flow paths;

an orifice plate provided with discharge ports for discharging ink each arranged to be communicated with one end of each of the grooves; and an ink liquid chamber communicated with each of the grooves on one end of each of the grooves for supplying ink to each of the grooves, a plurality of ink discharge paths being formed by bonding a ceiling plate member having the grooves, the orifice plate, and the ink liquid chamber integrally formed therefor with the substrate member, wherein the ceiling plate member comprises a first substrate having a portion including at least the circumference of the discharge ports of the grooves and the orifice plate, and a second substrate comprising the portions with the exception of the first substrate, and the first substrate and the second substrate are bonded to be integrally formed by means of a bicolor molding, and at the same time, an insert member is arranged on the boundary surface between the second substrate and the first substrate.

In accordance with the present invention, the ceiling plate is structured by a first substrate formed by the portion that includes the grooves that constitute ink flow paths and the circumference of discharge ports, and a second substrate which is formed by the portions other than the first substrate. These substrates are molded by means of bicolor molding. In this way, the first substrate is molded in a comparatively uniform thickness. As a result, there is no excessive loss of pressure when the resin, which is injected into a metallic die at the time of molding the first substrate, flows, hence stabilizing the resin flow and its orientation to enhance the resultant molding precision and filling precision of the ceiling plate member. On the other hand, an insert member is arranged on the boundary surface between the second substrate and the first substrate. The insert member is nipped by the first and second substrates. In this manner, the drawback brought about by the thermal expansion, and the problem related to rigidity, which are regarded as weakness of the conventional ceiling plate, are improved by the presence of the insert member, hence making it possible to mold a ceiling plate having multiple functions in high precision which cannot be implemented by the monochromatic insertion molding. Also, the second substrate becomes a simple shape so that the space needed for the arrangement of the insert member is easily secured.

With the arrangement of the insert member, the present invention makes it possible to improve the molding precision and the rigidity of the ceiling plate member. However, with the enhancement of the molding precision, the amount of warp is made smaller on the contact surface of the ceiling plate member with the substrate member to make it possible to correct the warping with a small amount of pressure when the ceiling plate and substrate members are in contact closely. On the other hand, the rigidity becomes greater by the presence of the insert member. As a result, the inner distortion which is caused by the ceiling plate member becomes smaller. Also, it becomes possible to suppress the heat shrinkage in the grooves in the arrangement direction thereof, which is brought about by the relative difference in the coefficients of thermal expansion of resin of the insert member and resin on the circumference thereof at the time of environmental changes.

With respect to the ceiling plate member, the extremely thinner portion, such as an orifice plate, has a great flow resistance to the resin which has been injected at the time of molding, and if such thinner portion spreads in a wide range, the resin filling becomes extremely difficult. Therefore, as a molding resin, it is preferable to adopt the one which presents a lower viscosity when fused, and has a higher flowability. However, resin that can satisfy such condition is limited. On the other hand, it is required to conduct severe control on various molding conditions, such as the temperature control of the metallic die and resin, the control of the injection pressure and injection speed, and the adjustment of the metallic die with respect to the molding surface. Here, therefore, the orifice plate is divided into two for molding. Then, the thinner area becomes smaller per molding process, and the formability is enhanced significantly as compared with the case where the orifice plate is molded as a whole at a time. Further, the molding precision is also improved.

Particularly when the orifice plate is divided into the upper and lower portions, and then, the structure is arranged so that the first substrate includes the lower portion, while the second substrate includes the upper portion, it becomes possible to reduce the degree of molding difficulty considerably, because the thinner portion on the first substrate is made smaller. Also, the first substrate becomes simple having a comparatively uniform thickness in its configuration. As a result, the transferability, the molding precision, and the surface precision of the contact surface with the substrate member are improved. On the other hand, the precise groove portion on the second substrate, which makes the degree of molding difficulty higher, is eliminated to make molding easier when it is performed.

It is preferable to mold the second substrate by the first molding of the bicolor molding. Then, the insert member is molded by means of the insertion molding at the time of the first molding. As a result, the insert member can be held easily in the metallic die. In other words, one surface of the insert member is exposed to the surface of the primarily finished product. This exposed portion is in contact with the transfer surface of the metallic die. Therefore, it is made possible to adopt various methods for holding the insert member in the metallic die. With respect to the finished product, there is a need for securing a space in order to hold an insert member of the kind, but as the second substrate has more usable space on the circumference of the boundary surface as compared with the first substrate, thus making it easier to secure the required space for the insert member. Under the circumstances, it is preferable to mold the second substrate at the time of first molding.

Also, if the insert member has a high rigidity, there is a possibility that the insert member can withstand the shrinking stress of resin at the time of first molding. Thus, this member is not caused to warp, which enables the boundary surface with the first substrate to be flat in good condition, with the result that resin can flow stably on the circumference of the groove walls when the second molding is performed. In this manner, the transfer precision of the grooves is improved, and further, the surface precision of the contact surface with the substrate member becomes extremely favorable.

Also, if the insert member is provided with irregular lines, such as ribs, bellows, bosses, pedestals, rectangles, or the like, the voluminal changes of the circumference of ink flow paths is physically blocked by the presence of such lines even when the ceiling plate member is placed under the environment that may cause great temperature changes. Further, if the irregularity is provided by means of undercut or the like, for example, the bonding strength between the insert member and both substrates is enhanced to make it difficult for them to be peeled off, and at the same time, the effect that may be produced on the thermal expansion and the rigidity of the ceiling plate member is demonstrated still more.

DETAILED DESCRIPTION OF THE PREFERRED EMBODIMENTS (First Embodiment)

In conjunction with FIG. 1 to FIG. 5, the description will be made of a liquid discharge recording head in accordance with a first embodiment of the present invention.

Figure 1:
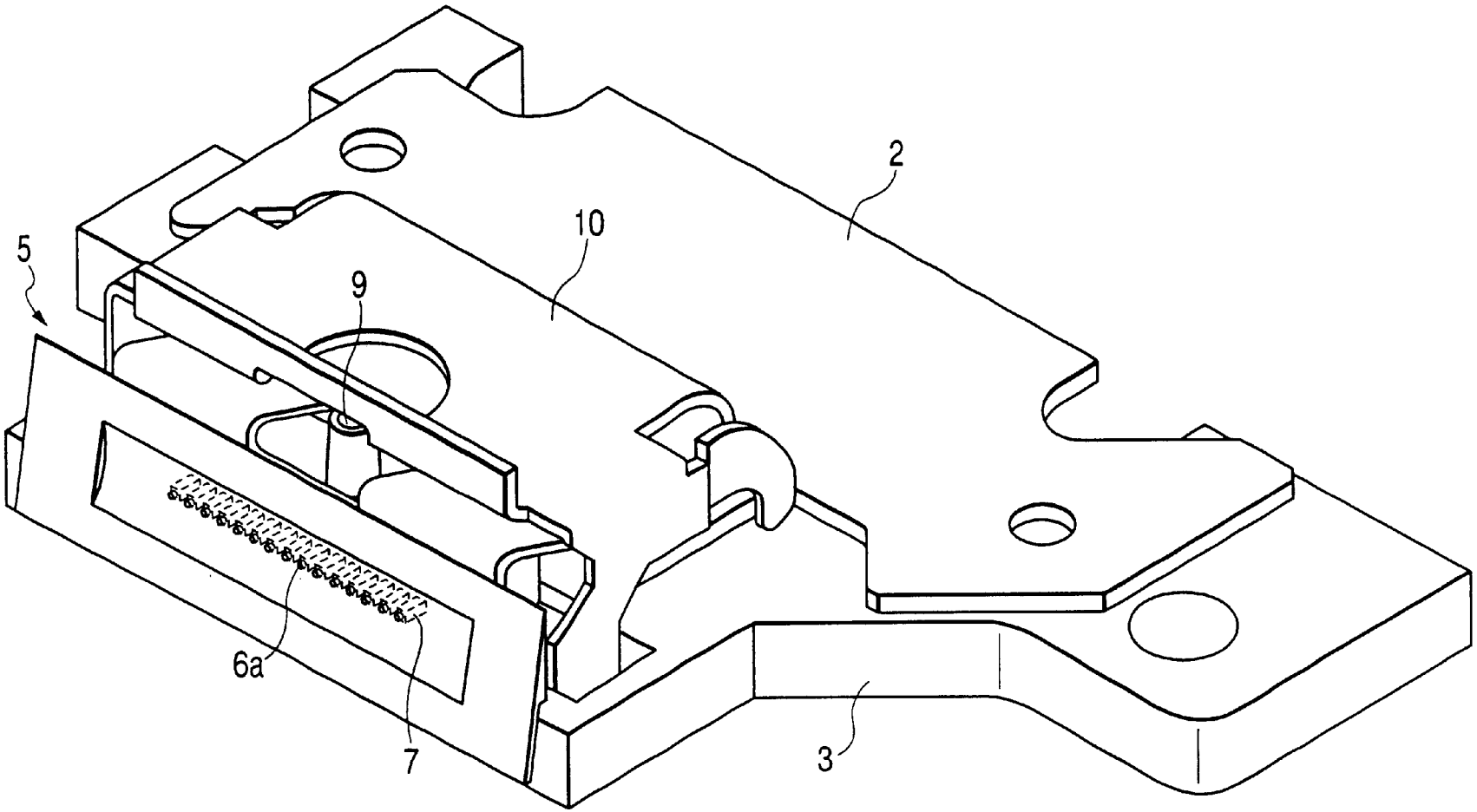
FIG. 1 is a perspective view which schematically shows one example of the chip structure of a liquid discharge recording head in accordance with a first embodiment of the present invention.
Figure 2:
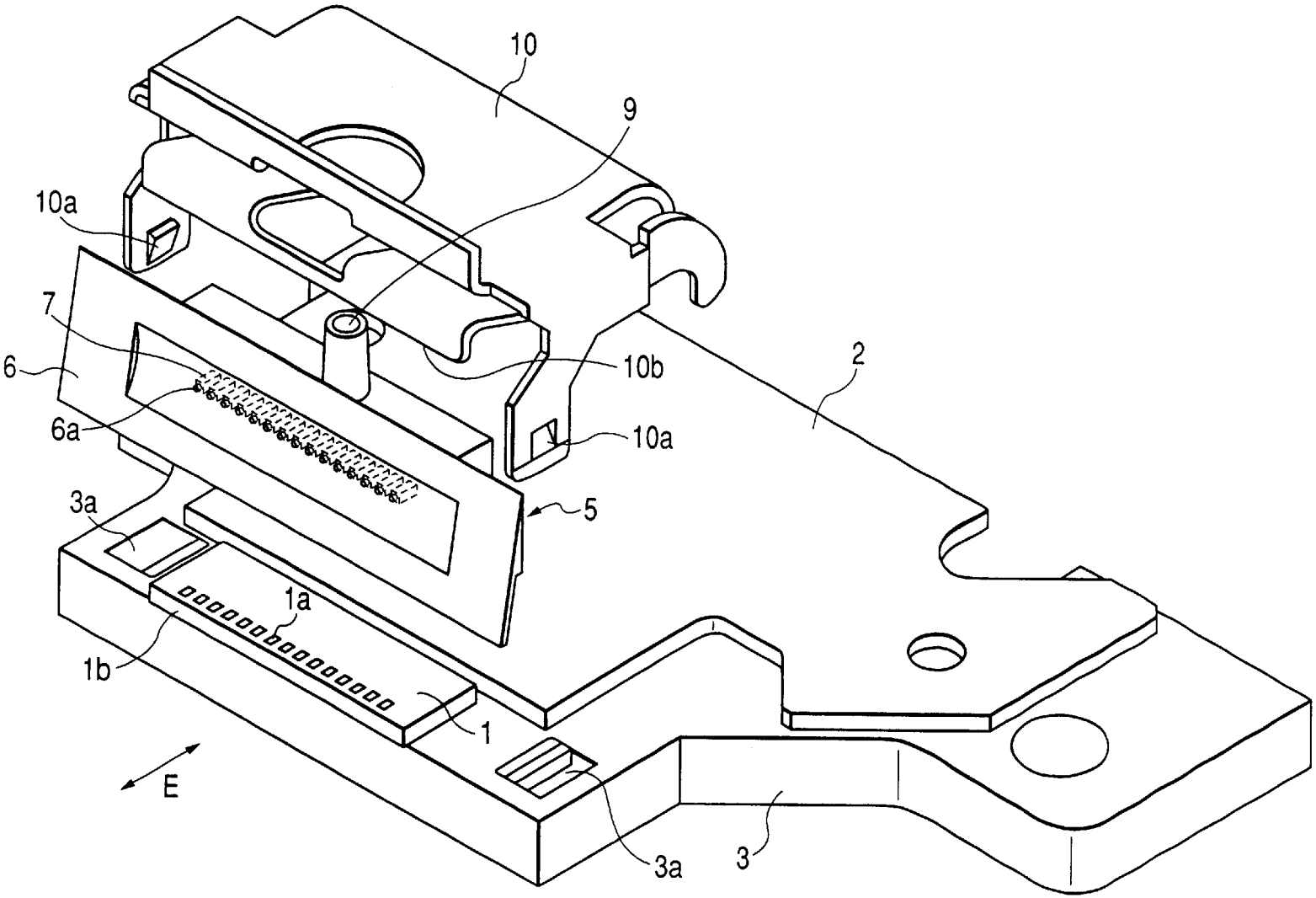
FIG. 2 is an exploded perspective view which shows the liquid discharge recording head represented in FIG. 1.
Figure 3:
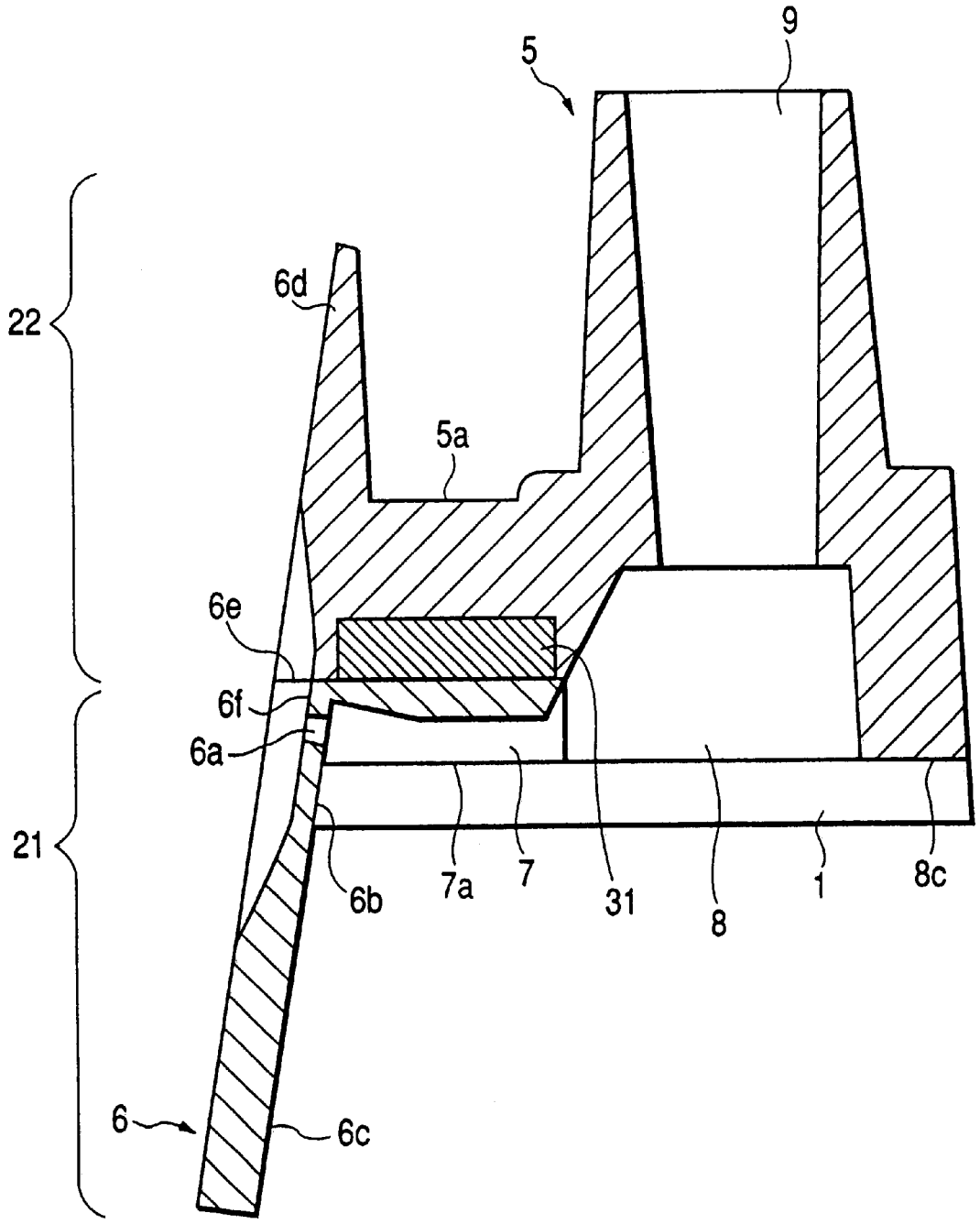
FIG. 3 is a cross-sectional view which shows the ceiling plate represented in FIG. 1.
Figure 4:
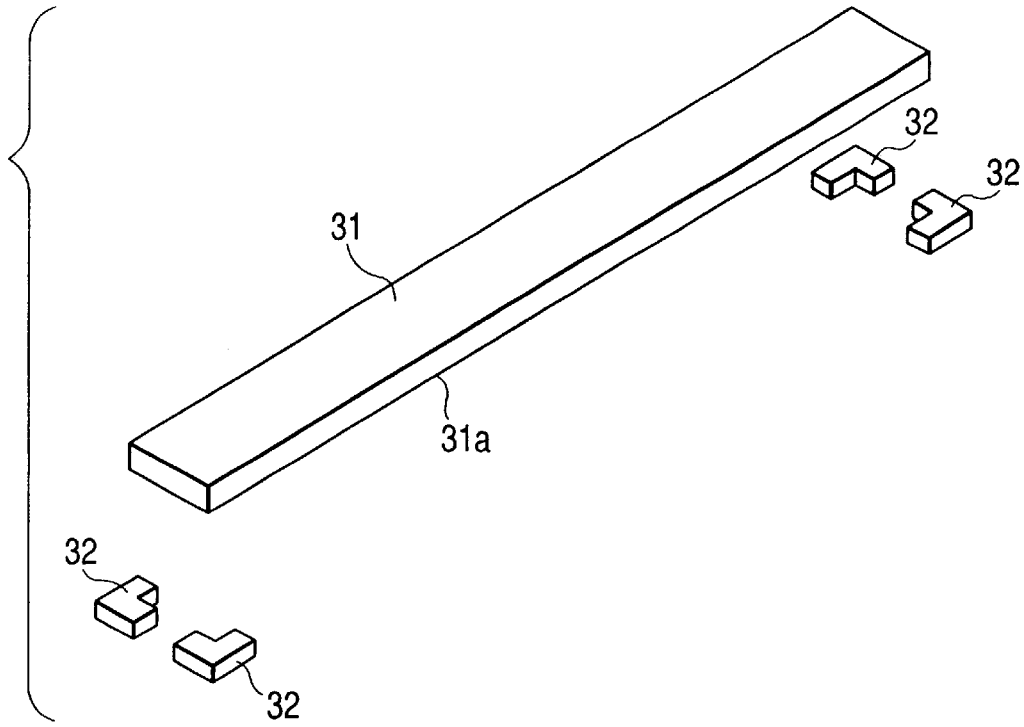
FIG. 4 is a perspective view which shows the state before the insert member represented in FIG. 3 is set on the metallic die.
Figure 5:
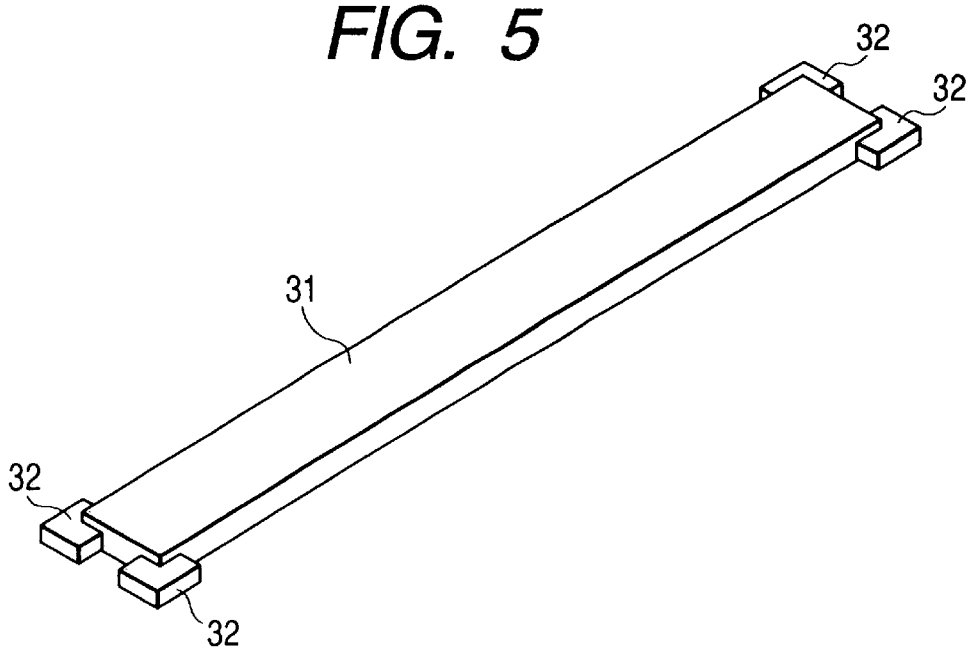
FIG. 5 is a perspective view which shows the state after the insert member represented in FIG. 3 is set on the metallic die.

FIG. 1 is a perspective view which schematically shows one example of the chip structure of a liquid discharge recording head in accordance with a first embodiment of the present invention. FIG. 2 is an exploded perspective view which shows the liquid discharge recording head represented in FIG. 1. FIG. 3 is a cross-sectional view which shows the ceiling plate represented in FIG. 1. FIG. 4 and FIG. 5 are perspective views which schematically illustrate the state of the insert member being set on the metallic die.

At first, the structure of the liquid discharge recording head will be described.

The heater board 1 comprises electrothermal transducing elements (discharge heaters) 1*a* serving as the elements that generate energy used for discharging ink, and wiring to supply electricity to the discharge heaters 1*a,* which are formed on a silicon substrate by the silicon film formation processing. The wiring arranged for the heater board 1 is connected with a wiring substrate 2 by means of wire bonding, for example. Then, with the wiring substrate 2, the heater board 1 and the main body of an ink jet recording apparatus are in contact electrically. As the wiring substrate 2, there is used, among some others, a PWB substrate formed by the glass epoxy substrate which is provided with a wiring pattern of copper or nickel or a TAB film formed by a flexible film or the like with the wiring pattern thereon.

The heater board 1 and the wiring substrate 2 are installed on a supporting substrate (hereinafter referred to as a base plate) 3 which is formed by aluminum or the like. The heater board 1 is die bonded on the base plate 3. Also, the wiring substrate 2 is adhesively bonded on the base plate 3 by the application of adhesives. The base plate 3 functions also as a heat sink which radiates heat of the heater board 1 generated along with the driving of the discharge heaters 1*a* and cools it.

On the area of the base plate 3 that includes the heater board 1, the ceiling plate 5 is bonded to form ink flow paths. The ceiling plate 5 comprises an orifice plate 6 having a desired number of ink discharge ports 6*a* formed for it to discharge ink to a recording medium; the nozzles 7 that serve as the ink flow paths communicated with the ink discharge ports 6*a* with the recessed grooves on the lower face of the ceiling plate 5, which correspond to each of ink discharge ports 6*a;* the ink liquid chamber 8 which serves as a sub-tank to supply ink to the recessed nozzles 7 formed on the lower face of the ceiling plate 5; and the ink supply port 9 through which ink is supplied from an ink storage tank (not shown) to the ink liquid chamber 8. In this respect, the ceiling plate 5 is integrally formed by means of a bicolor molding which will be described later.

The thickness of the orifice plate 6 is several tens of $\mu$m to several hundreds of $\mu$m. However, if the thickness becomes larger, it takes longer to finish laser processing, thus inviting the degradation of the processing precision. Further, due to the laser processing, the ink discharge ports 6*a* should be made each in the form of contracted diameter hole, and if the portion where the holes are provided is thick, a desired area can hardly be secured for the provision of the discharge ports, because the diameter of each discharge port is made smaller inevitably. Generally, therefore, the circumference of the discharge ports is formed in a thickness of as extremely small as 20 $\mu$m to 70 $\mu$m.

Also, the thickness of the leading end of each grooved wall of the nozzles 7, which is the closely contacted surface with the heater board 1, is in an extremely small dimension, such as several $\mu$m to several tens of $\mu$m thick, and several tens of $\mu$m to several hundreds of $\mu$m deep.

As described above, the orifice plate 6 and nozzles 7 are extremely thin and finely configured as well. Therefore, the ceiling plate is formed by use of a high speed injection molding machine with the molding material the flowability of which is extremely smooth.

In this respect, the ceiling plate 5 is either structured integrally with the orifice plate 6, nozzles 7, ink liquid chamber 8, and ink supply port 9 altogether or structured likewise, but only the orifice plate 6 is arranged separately as an individual member, among some other structures.

The ceiling plate 5 is closely in contact with the heater board 1 from above by means of a pressure spring 10. The pressure spring 10 is adjusted to align completely with the relative positions of the discharge heaters 1*a* and the nozzles 7, and then, to press the ceiling plate 5 from the receptacle 5*a* arranged above the nozzles 7. In other words, the nails 10*a* provided for the lower edges of the pressure spring 10 are inserted into the holes 3*a* provided for the base plate 3, respectively. Then, the folded portions of the nails 10*a* are hooked on the lower face of the base plate 3. In this manner, the pressing sections 10*b* of the pressure spring 10 depress the receptacle 5*a* of the ceiling plate 5 to exert mechanical pressure on the contacted portion on the lower face 7*a* of the nozzles. By the pressure of the pressure spring 10, the walls of the nozzles 7 are closely in contact with the heater board 1 completely, hence making it possible to partition each of the nozzles 7 exactly.

Also, as the orifice plate 6 is arranged for the front end 1*b* of the heater board 1 like an apron, the front end 1*b* of the heater board 1 is allowed to abut against the back face 6*b* of the orifice plate 6 to position the heater board 1 and the ceiling plate 5 in the direction of ink discharges (indicated by an arrow E in FIG. 2).

In this way, the heater board 1 and the ceiling plate 5 is in contact under pressure of the pressure spring 10. Therefore, the nozzles 7 are partitioned from each other completely. Nevertheless, since the pressure exerted by the pressure spring 10 does not act sufficiently upon the boundary surface between the orifice plate 6 and the front end 1*b* of the heater board 1, the contact between them becomes insufficient eventually.

Furthermore, with a step which is provided between the lower face 8*c* of the outer walls of the ink chamber 8 and the lower face 7*a* of the nozzles, a gap of several $\mu$m to ten and several $\mu$m is created between the lower face 8*c* of the outer walls of the ink chamber 8 and the heater board 1 when the nozzles 7 and the heater board 1 are closely in contact. Then, with the presence of such portion as having insufficient contactness or such gap, ink leakage occurs inevitably to disable the liquid discharge recording head to perform its function.

Therefore, in order to prevent ink from leaking from the portion having insufficient contact or a gap, a sealant, such as silicone, is injected into the boundary surface between the heater board 1 and the ceiling plate 5 to fill it in each of such portion or gap. More specifically, the sealant is filled in the gap between the back face 6*b* of the orifice plate 6 and the front face 1*b* of the heater board 1, the gap between the back face 6*b* of the orifice plate 6 and the front face 3*b* of the base plate 3, and the bonded portion between the ceiling plate 5, the heater board 1 and the base plate 3, among some others. When sealing each of the gaps and bonded portions, the sealant is allowed to flow into each of the specific areas by the application of the capillary force generated between the sealant and each gap between respective members. Then, in order to prevent the sealant from flowing into other portions than those specific areas, the configuration of each member is devised, and at the same time, the viscosity of the sealant is controlled appropriately for the intended sealing.

However, the gap between the back face 6*b* of the orifice plate 6 and the front face 1*b* of the heater board 1 is so small that the sealant injection becomes most difficult. Then, there is a need for the visual confirmation to ascertain whether or not the sealant has been filled in a desired range. If the orifice plate 6 is transparent, it is possible to confirm the filling condition of the sealant from the front face of the orifice plate 6. It is, therefore, preferable to make the orifice plate 6 portion transparent.

Now, in conjunction with FIG. 3 to FIG. 5, the description will be made of the structure of a ceiling plate 5 which is formed by the combination of the bicolor molding and the insertion molding.

The ceiling plate 5 is formed by a first substrate 21 and a second substrate 22. The first substrate 21 and the second substrate 22 are bonded and formed by means of the bicolor molding. The first substrate 21 comprises the lower portion 6*c* of the orifice plate and the nozzles 7. The second substrate 22 comprises the upper portion 6*d* of the orifice plate, the ink liquid chamber 8, the ink supply port 9, the receptacle 5*a* and the outer circumference of the ceiling plate 5. In other words, with the boundary surface 6*e* arranged in the vicinity above the nozzles 7, the orifice plate 6 is separately formed into the lower portion 6*c* of the orifice plate and the upper portion 6*d* thereof. Then, the flat plate type insert member 31, which is formed by metal, ceramics, silicon, resin filled with fillers, or the like, is arranged for the boundary surface 6*e*.

As described above, the first substrate 21 and the second substrate 22 are bonded and formed by means of the bicolor molding, and the upper and lower portions of the orifice plate 6 are integrated with the ceiling plate 5. In this way, therefore, if the first substrate 21 and the second substrate 22 are formed by different kinds of materials each having good bonding property or formed by the same material, both substrates are completely bonded together after the bicolor molding. The insert member 31 is firmly nipped by both substrates. Also, both of them are bonded at the time of molding, thus making it unnecessary to provide any particular steps in which assembling, adhesive bonding, and some others should be executed to complete the bonding process.

When the first molding is executed in the bicolor molding, the insert member 31 is inserted and held in the metallic die. For example, if the insert member 31 is in the form of a flat plate, one face thereof can be kept in close contact with the metallic die. It is then easier to hold the insert member 31 in the metallic die. Also, if the insert member 31 is formed with a flat surface, particularly if it is provided with the flat face on the side which becomes the boundary surface of the bicolor molding, flatness of the boundary surface can be secured.

FIG. 4 and FIG. 5 are views which illustrate the state of the insert member being set on the metallic die. FIG. 4 shows the state before the insert member is set on the metallic die, and FIG. 5 shows the state after it has been set on the metallic die. As shown in FIG. 4 and FIG. 5, the insert member 31 is set on the metallic die in good precision with the guide of the positioning members 32 of the metallic die. Then, the insert member 31 is held so that the bottom face 31*a* thereof is closely in contact with the metallic die.

The structure is arranged so that the insert member 31 is buried above the nozzles 7 when the ceiling plate 5 is in a state of being completed. However, the first substrate 21 and the second substrate 22 of the ceiling plate 5 are separated, while the insert member 31 is arranged on the boundary surface 6*e* between them. Thus, there is no need for the insert member 31 to float from the transfer surface of the metallic die when the insert molding is made (at the time of the first molding). In other words, for the first molded product, the bottom face 31*a* of the insert member 31 is exposed to the surface portion of the first substrate 21. Then, when the insertion molding is made, it becomes possible to set the bottom face 31*a* of the insert member 31 closely in contact with the transfer face of the metallic die, and hold it firmly on the metallic die.

Here, the metallic die is provided with the positioning portions 32. Therefore, at the time of the first molding, it is necessary for the positioning portions 32 thereof to secure the area to receive transfer. Now that the second substrate 22 can secure an excessive space on the circumference of the boundary surface 6*e,* it is preferable to mold the second substrate 22 at first. Here, the marks of the positioning portions 32, which have been transferred to the second substrate 22 at the time of the first molding (which becomes recessed portions in the finished product), can be buried easily with the secondary molding resin at the time of the second molding.

Also, the first substrate 21 is formed by the smaller thickness portion of the lower portion 6*c* of the orifice plate, and the small portions of the nozzles 7, which requires the severest molding precision for the formation of the ceiling plate 5, and presents the highest degree of difficulty for molding. This substrate is, therefore, formed by the material having a good flowability, which is suitable for precise molding, such as polysulfone, polyether sulfone, among some others. Such material should be transparent, and excellent in being processed by the application of laser, and should dually present the prerequisite for molding the orifice plate 6, as well as for processing ink discharge ports for the formation thereof. Further, since these materials should be pure, the wearing of the metallic die is made smaller unlike the one having the fillers in it. There is no fear, either, that the durability of the expensive die dwell is deteriorated for use of the nozzle transfer.

On the other hands, the material, such as metal, ceramics, silicon, or resin filled with fillers, is used for the insert member 31, as described earlier, and the rigidity thereof becomes much greater than that of the molding resin of the ceiling plate. As a result, if the insert member 31 is held between resin materials by the insertion molding, the deformation, warping, or the like is prevented by the rigidity of the insert member 31 from occurring on the circumference of the boundary surface 6*e* of the finished first product. Moreover, as the insert member 31 constitutes a part of the boundary surface 6*e,* the flatness of the boundary surface 6*e* is kept in good condition.

As described above, the second substrate 22 provides the higher surface precision of the boundary surface 6*e* by means of the insertion molding, while the first substrate 21 is simply configured by the lower portion 6*c* of the orifice plate and nozzles 7. As a result, it becomes possible to attempt the enhancement of the molding precision on the circumference of the nozzles 7, because the molding resin flows on the area the thickness variation of which is smaller, having good flatness when the nozzles 7 are formed in the vicinity below the boundary surface 6*e* at the time of the second molding.

Further, if the insert member 31 should be formed with a material having a good heat conductivity, the bottom face 31*a* of the insert member 31 is heated by the second molding resin instantaneously at the time of the second molding. Therefore, any abrupt cooling is suppressed with respect to the second molding resin that flows on the circumference of the boundary surface 6*e*. Then, resin flows, while keeping the lower viscosity thereof, which makes it possible to facilitate transfer to the nozzles 7, and improve the formability of the second molding significantly.

Also, the orifice plate 6, which is a member having such an extremely small thickness that makes resin filling very difficult, is divided into two and formed in the two steps, that is, the molding of the first substrate 21 and that of the second substrate 22. As compared with the conventional one in which the orifice plate is formed in one molding process, the area of the thinner thickness portion is made smaller, and the degree of difficulty is reduced when filling resin, hence enhancing the productivity, as well as the molding precision significantly.

As described above, for the formation of the ceiling plate 5, the combination of the bicolor molding and the insertion molding is extremely effective means for improving the molding precision of the ceiling plate 5. Also, this means makes it possible to obtain the rigidity which cannot be obtained by a resin molded product. Therefore, with the enhancement of the molding precision by means of the bicolor molding combined with the enhancement of the rigidity by means of the insertion molding, the flatness of the lower face 7*a* of the nozzles is improved. Combined with this, the enhanced rigidity of the ceiling plate 5 and orifice plate 6 makes it possible to significantly reduce the inner distortion when the ceiling plate 5 and the heater board 1 are in close contact with each other.

In this way, the discharge port array is arranged in high precision without any noticeable displacement of the relative positions, thus making it possible to manufacture a liquid discharge head which is capable of discharging ink stably.

Here, if the second substrate 22 is formed with resin containing fillers, the elastic modulus on the circumference of nozzles 7 becomes extremely large by the effects produced by both the second substrate 22 and the insert member 31. The rigidity of the ceiling plate 5 is enhanced still more.

Also, if resin is filled with fillers, the molding shrinkage of such resin is eased by the fillers, and the molding precision of the second substrate 22 is automatically enhanced. Therefore, both the first substrate 21 and the second substrate 22 present the enhanced molding precision. Hence, the ceiling plate 5 may present itself as a highly precise finished product when completed by bonding both of them. Moreover, if the second substrate 22 is formed by the metal injection that uses material, such as magnesium alloy, SUS, iron, or steel, or the ceramics injection that uses ceramics, or the like, it becomes possible for the ceiling plate 5 to obtain the rigidity that cannot be obtained by the resin molding.

As described earlier, the material usable for the nozzles 7 is limited for the reasons of the molding, sealing, laser processing, and the like. As a result, there is automatically a limit to minimizing the thermal expansion in the arrangement direction of the nozzles 7. Now, therefore, if the insert member 31, which is formed by the material that withstands thermal expansion, is inserted into the ceiling plate 5 by means of the insertion molding. Then, as in the case described above, the insert member 31 may be able to compensate structurally for the weakness of the first substrate 21 resulting from the thermal expansion.

As shown in FIG. 3, the boundary surface 6*e* of the orifice plate 6 is provided in the vicinity above the ink passage communicated from the nozzles 7 to the ink discharge ports 6*a*. Then, if an insert member 31 is formed with the material having a smaller coefficient of thermal expansion, the insert member 31 functions to block the thermal expansion of the ink passage that may be caused to occur in its arrangement direction when the environment changes. Thus, with the arrangement of the insert member 31 formed by a material having a lower thermal expansion in the vicinity above the entire area of the ink passage communicated from the nozzles 7 to the ink discharge ports 6*a,* there is eliminated any possibility that the nozzles 7 and the ink discharge ports 6*a* are caused to be deformed each individually, and that the relative directions of the nozzles 7 and the ink discharge ports 6*a* are caused to change.

The coefficient of linear expansion of the insert member 31 is different depending on the entire length of the arrangement direction of the nozzles 7, various conditions of use environment, and the like. However, if the coefficient of the linear expansion of the insert member 31 and the installing location of the insert member 31 are selected so that the expansion of the insert member in the arrangement direction of nozzles 7 may be kept in ¼ or less of the arrangement pitches of the nozzles 7, it becomes possible to manufacture a liquid discharge head which does not produce any unfavorable influence on the discharge performance even if the variation of each parameter is taken into consideration as to the precision of each part, the precision of assembling thereof, the nozzle configuration, and the pressure of the pressure spring 10, among some others.

For example, in a case of the ceiling plate 5 for which the nozzles 7 are arranged in the range of the total length of 12.7 mm (the number of nozzles is 300) at the arrangement pitches equivalent to 600 dpi, and the first substrate 21 is formed by polysulfone, it is preferable to set the thermal expansion of the nozzle 7 portion at $1.86\times10^{-5}/°$ C. in terms of the coefficient of linear expansion, because the coefficient of the linear expansion of polysulfone is $5.6\times10^{-5}/°$ C.

In this respect, if the close contactness between the insert member 31 and both of the first substrate 21 and second substrate 22 is small, it becomes impossible for the insert member 31 to suppress the thermal expansion and the inner distortion of the ceiling plate 5 sufficiently. Now, therefore, adhesiveness is provided for the insert member 31 by applying an adhesive agent to it or the like in order to increase the close contactness between the insert member 31 and both of the substrates. Then, the insert member 31 can demonstrate the effect of its rigidity, the suppression of thermal expansion, and the like efficiently.

Also, if the insert member 31 is formed with the resin which is enforced with fillers or the like, and at the same time, the base resin of the insert member 31 is the one that can be bonded to the molding resin of the first substrate 21 and the second substrate 22, the insert member 31 is fused together with both substrates after molding, thus securing a sufficient bonding strength, and the performance of the insert member 31 is reflected upon that of the ceiling plate 5 more effectively.

Also, in order to enable the insert member 31 to perform its function more effectively on the entire area of the arrangement direction of nozzles 7, it is preferable to make the length of insert member 31 in the arrangement direction of the nozzles 7 longer than the entire length of the nozzles 7 in that direction.

Also, there are formed ribs, bellows, bosses, pedestals, rectangles, and other irregular arrays or tapered holes on the bonding interface between the insert member 31 and the first substrate 21. As a result, the bonding area between the insert member 31 and the first substrate 21 becomes larger to make it possible to improve the bonding between them. Moreover, with the irregular arrays or tapered holes on the insert member 31, the effect of lower thermal expansion of the insert member 31 acts more effectively upon the first substrate 21. Then, the voluminal changes on the circumference of the nozzles 7 is blocked structurally. The voluminal changes of the first substrate 21 is also suppressed accordingly. Further, if the irregular lines or the tapered holes on the insert member 31 are formed so that the first substrate 21 and the insert member 31 may become undercut in the direction in which these tend to be peeled off, it becomes possible to make them integrated even when the degree of the close contactness is smaller between the insert member 31 and the first substrate 21.

Further, if the pitches of the irregular lines or the tapered holes on the insert member 31 are arranged in the same direction as the arrangement direction of the liquid flow path walls, it becomes possible to make the displacement smaller for the relative positions between the heaters and the ink passage from the ink discharge ports to the liquid flow paths. Also, if the irregular lines can be arranged for both faces of the insert member 31, it becomes possible for the insert member 31 to make its contacting forces stronger with respect to both the first substrate 21 and the second substrate 22. As a result, the performance of the insert member 31 is reflected upon that of the ceiling plate 5 in a better condition.

The description has been made so far of one example of the ceiling plate 5 to which the first embodiment is applicable in accordance with the present invention. However, the present invention is not necessarily limited only to the mode and configuration of the ceiling plate described above. The invention is executable with respect to any types of ceiling plate, and the same effect can be anticipated.

For example, in accordance with the present embodiment, the ink supply port 9 is arranged in the direction intersecting the direction of ink discharges. However, the same effect is obtainable even when the ceiling plate is structured so that the ink supply port 9 is arranged in parallel to the direction of ink discharges.

Also, if the structure is arranged so that the surface layer of the orifice plate 6 is separated from the main body of the orifice plate, and that a material having good water-repellency is used for the surface layer of the orifice plate, and the first substrate, the second substrate, and the surface layer of the orifice plate are bonded by means of three color molding to complete the ceiling plate, it becomes possible to simplify the manufacturing process of the ceiling plate, because the water-repellent treatment given to the surface of the orifice plate, which has been executed by a secondary process, is now made executable in the molding process.

Also, means for enhancing the rigidity of the ceiling plate 5 is not necessarily limited to the method in which a material having larger elastic modulus is adopted. There may be a method in which the configuration of the ceiling plate is devised in order to increase its rigidity structurally. Here, it may also be possible to increase the rigidity of the ceiling plate 5 by developing both the material and structure to be adopted.

Also, in accordance with the present embodiment, the orifice plate 6 is structured by dividing it into two. However, it is of course possible to arrange the structure so that the entire area of the orifice plate is included in the first substrate or it may be possible to arrange the structure so that the orifice plate is divided into three or more for its formation. Further, a structure may be arranged so that the orifice plate 6 and the nozzles 7 are separated, and then, formed by means of multiple color molding.

Also, the insert member 31 is not necessarily limited to a polyhedral shape, such as a flat plate, but it may be a solid or hollow cylindrical shape. Also, the insert member may be molded with a material which is different from the base resin of the first substrate 21 and the second substrate 22 if only it is possible for the first substrate 21 and the second substrate 22 to secure the minimum contacting force.

(Second Embodiment)

Figure 6:
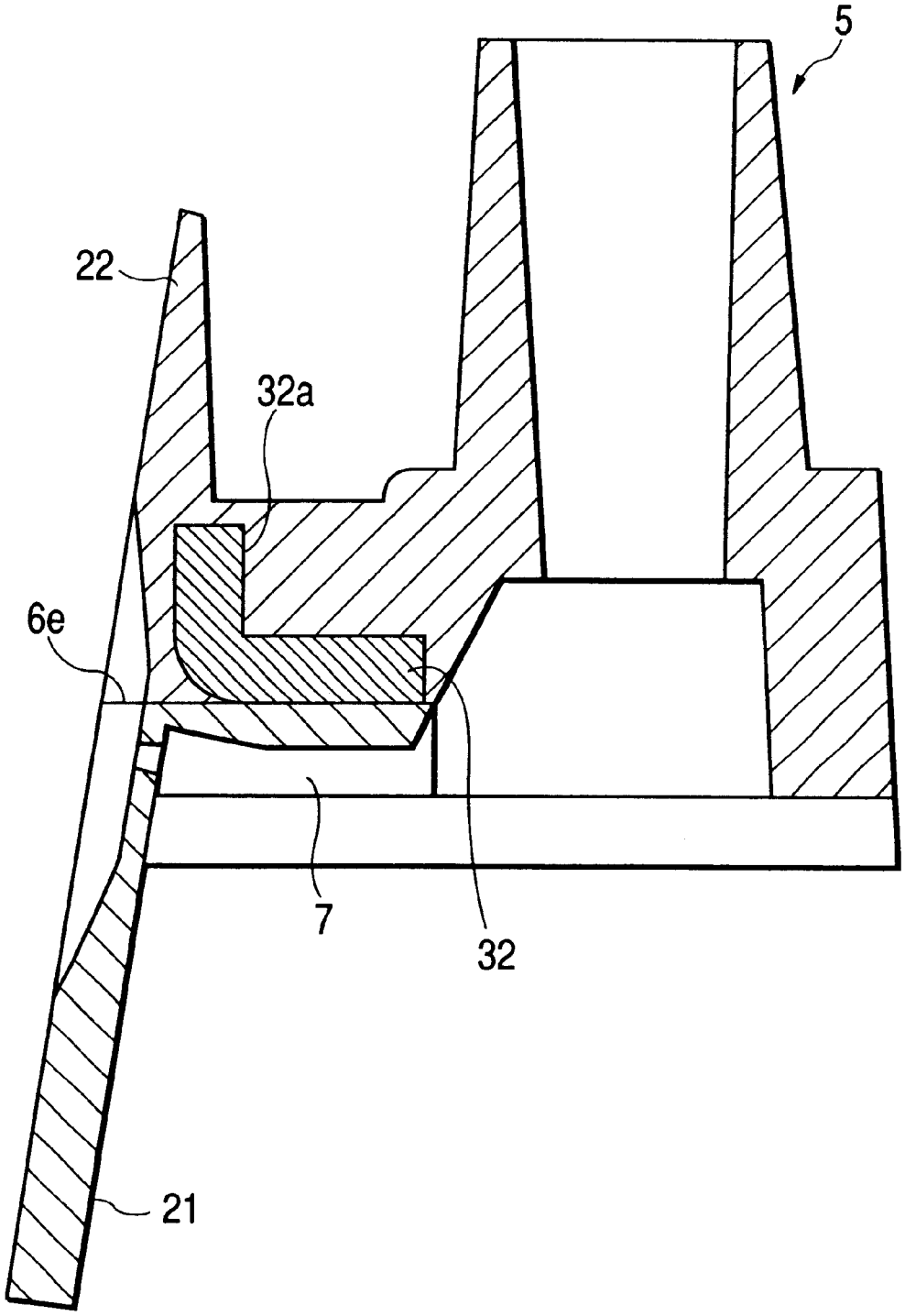
FIG. 6 is a cross-sectional view which illustrate schematically the ceiling plate of a liquid discharge recording head in accordance with a second embodiment of the present invention.

FIG. 6 is a cross-sectional view which shows schematically the ceiling plate of a liquid discharge recording head in accordance with a second embodiment of the present invention.

In accordance with the present embodiment, the bending portion of an insert member is folded in the arrangement direction of the nozzles in order to enhance the rigidity of the insert member.

Hereunder, with reference to FIG. 6, the description will be made of the second embodiment of the present invention by applying the same reference marks to the same parts as those appearing in the embodiment described above.

The insert member 32 is arranged on the boundary surface 6*e* between the first substrate 21 and the second substrate 22, which is provided with a bending portion 32*a* folded in the arrangement direction of the nozzles 7 (in the depth direction in FIG. 6). The insert member 32 receives a large filling pressure of resin at the time of molding, and also, receives thermal energy. Therefore, it is required for the insert member to be strong enough to withstand such condition. Also, as the ceiling plate 5 is an extremely small part fundamentally, the installation space of the insert member 32 is considerably limited. Then, even if the insert member 32 is formed by a material having a great rigidity, it is not easy for this member to withstand the filling pressure of resin under a high temperature environment. Here, for example, the molding temperature of polysulfone is set at a temperature of as extremely high as 360° C. to 400° C.

As described in the present embodiment, the insert member 32 which is in the form of flat plate should be provided with the bending portion 32*a* to be folded to make its rigidity larger in the arrangement direction of nozzles 7. Then, it is easier to form an insert member 32 which is capable of withstanding the filling pressure of resin and the stress that may be generated when resin is hardened to shrink.

(Third Embodiment)

Figure 7:
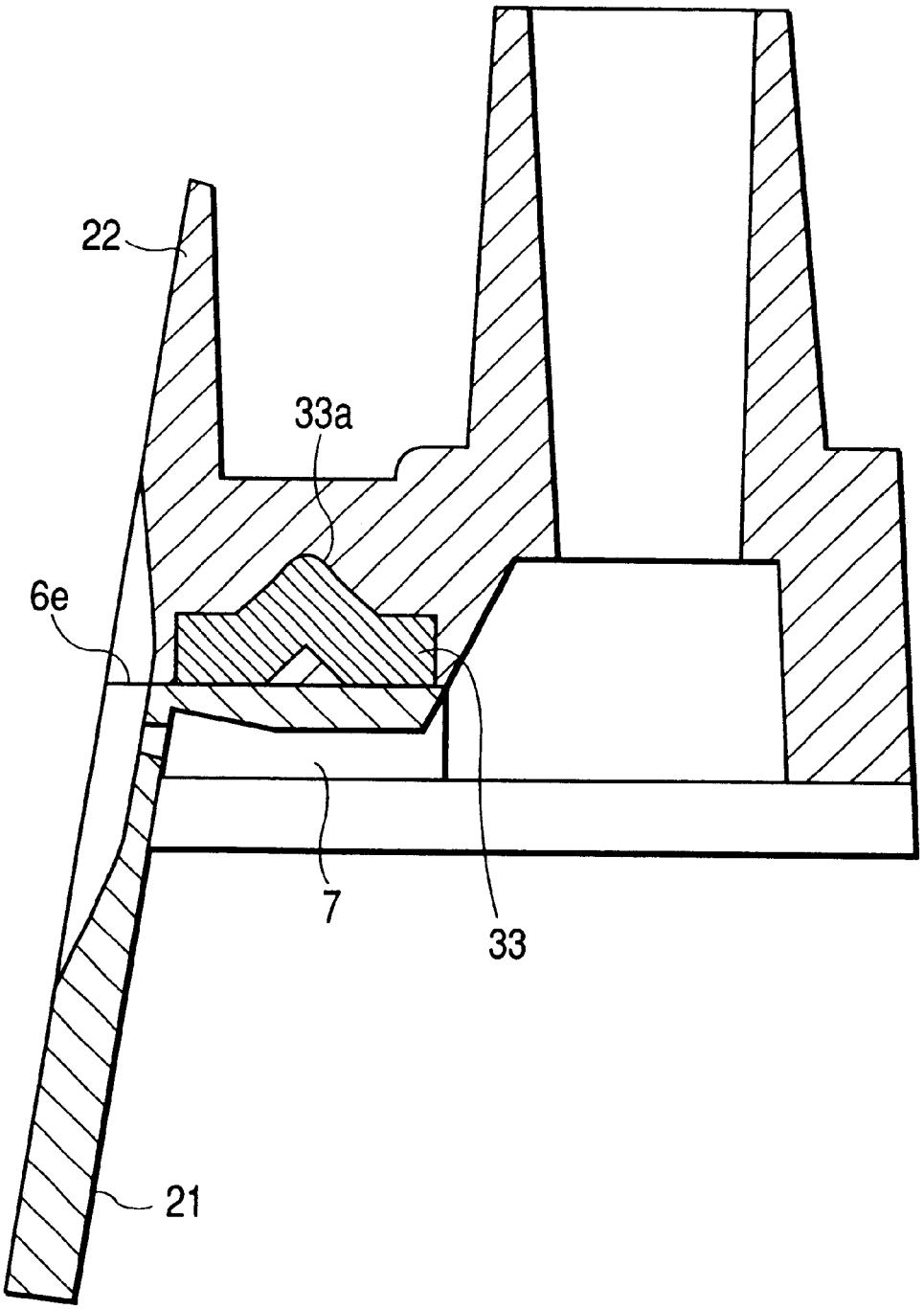
FIG. 7 is a cross-sectional view which illustrate schematically the ceiling plate of a liquid discharge recording head in accordance with a third embodiment of the present invention.
Figure 8:
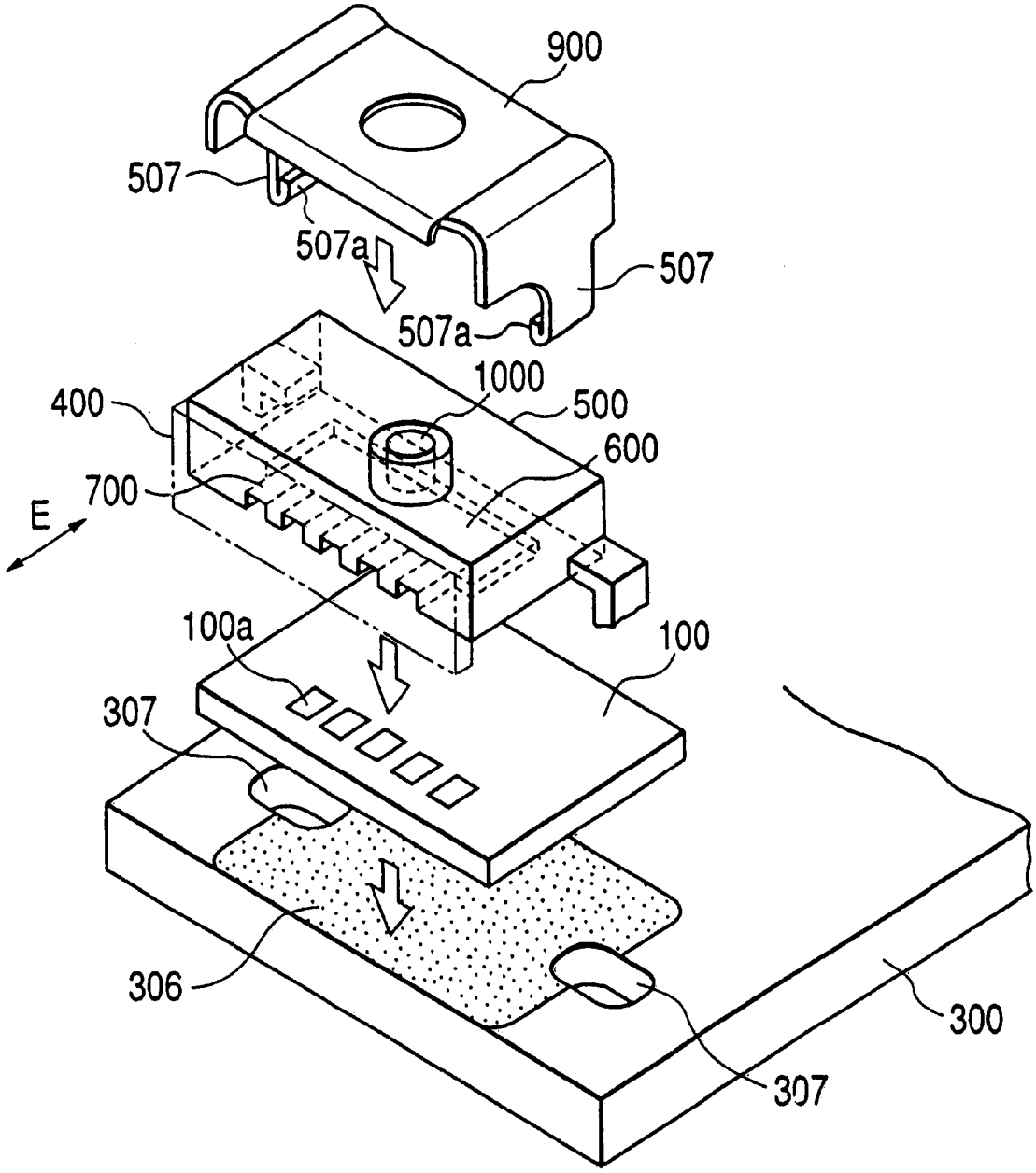
FIG. 8 PRIOR ART
FIG. 8 is a view which schematically shows the conventional liquid discharge recording head.
Figure 9:
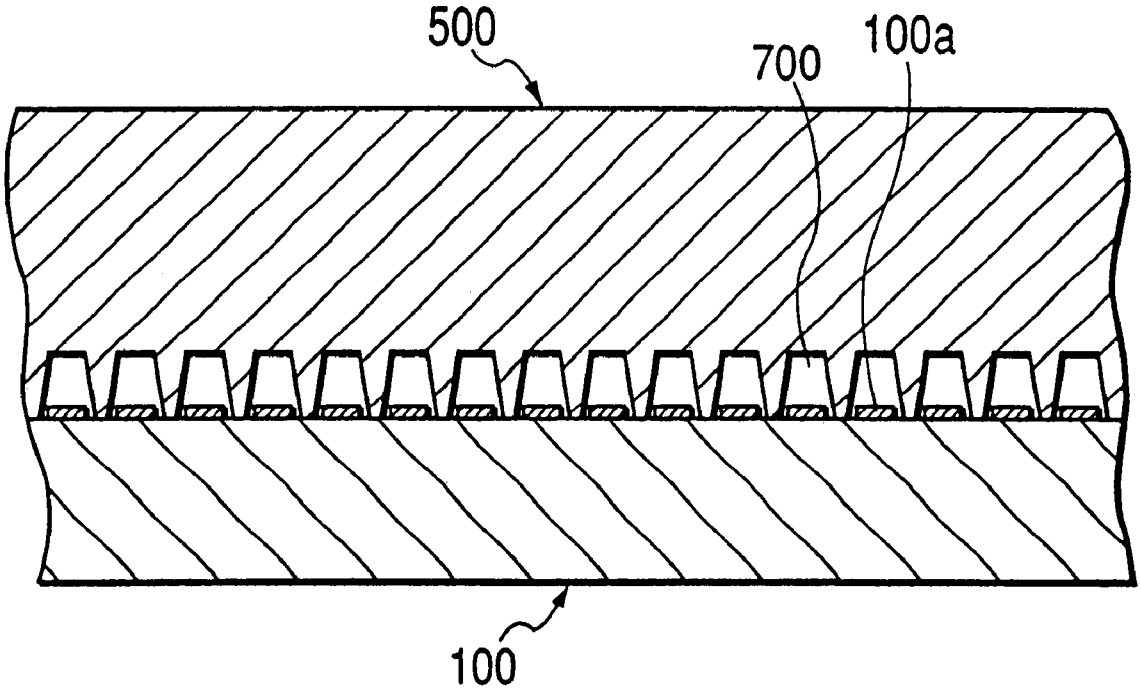
FIG. 9 PRIOR ART
FIG. 9 is a cross-sectional view which shows the bonded state of the ceiling plate and the heater board of the liquid discharge recording head represented in FIG. 8.

FIG. 7 is a cross-sectional view which shows schematically the ceiling plate of a liquid discharge recording head in accordance with a third embodiment of the present invention.

In accordance with the present embodiment, a bead portion is provided for the insert member in the arrangement direction of the nozzles in order to enhance the rigidity of the insert member even in a smaller area.

Hereunder, with reference to FIG. 7, the description will be made of the third embodiment of the present invention by applying the same reference marks to the same parts as those appearing in the embodiment described above.

The insert member 33 is arranged on the boundary face 6*e* between the first substrate 21 and the second substrate 22. Then the bead portion 33*a* is arranged in the arrangement direction of the nozzles (in the depth direction in FIG. 7). The bead portion 33*a* can be formed by press processing using a flat plate. Then, the range of the bead portion 33*a* in the arrangement direction of the nozzles 7 may be provided all over the insert member 33 or formed in such a manner that it ends at both edges.

Unlike the bending formation, the bead portion 33*a* can be formed with small steps, which is suitable for the enhancement of the rigidity of the insert member 33 in a narrow range.

As described above, in accordance with the present invention, the ceiling member is structured with the first substrate and the second substrate, which are formed integrally by means of the bicolor molding. Thus, the first substrate is in a thin and simple configuration, hence making it possible to enhance the transferability and the molding precision at the time of molding.

Then, the flow and orientation of the injected resin are stabilized to eliminate the excessive loss of pressure while resin flows. As a result, the transferability of the ink flow path portion, which requires a higher molding precision, is improved significantly. Also, the insert member is arranged on the boundary surface between the first substrate and the second substrate, which is nipped by both of them, hence solving the problems related to the thermal expansion and rigidity of the ceiling plate member, among some problems, to improve this member. More precisely, the thermal expansion of the ceiling plate member that may occur due to the environmental changes is blocked by the presence of the insert member. Also, the inner distortion that may occur in the ceiling plate member becomes smaller when the ceiling plate member and substrate members are bonded together, hence suppressing the displacement of the relative positions of the discharge port array. Further, at the time of molding, the warping that may take place in the ceiling plate member by the hardening shrinkage is suppressed by the presence of the insert member, hence enhancing the molding precision of the ceiling plate member.

Also, with the second substrate which is formed in the first molding, it becomes possible to hold the insert member simply and firmly, and easily secure the space needed for the provision of the insert member at the same time. Moreover, with the provision of folded bending portion or bead portion for the insert member, the rigidity of the insert member is enhanced to maintain the boundary surface with the first substrate in a good flatness.

What is claimed is:

1. A liquid discharge recording head comprising:

a substrate member having thereon a discharge energy generating element for giving discharge energy to ink corresponding to a plurality of ink flow paths arranged in parallel therefor;

a plurality of grooves corresponding to said plurality of ink flow paths;

an orifice plate provided with discharge ports for discharging ink each arranged to be communicated with one end of each of said grooves; and an ink liquid chamber communicated with each of said grooves on one end of each of said grooves for supplying ink to each of said grooves, a plurality of ink discharge paths being formed by bonding a ceiling plate member having said grooves, said orifice plate, and said ink liquid chamber integrally formed therefor with said substrate member, wherein said ceiling plate member comprises a first substrate having a portion including at least the circumference of said discharge ports of said grooves and said orifice plate, and a second substrate comprising the portions with the exception of said first substrate, and said first substrate and said second substrate are bonded to be integrally formed by means of a bicolor molding, and an insert member is arranged on the boundary surface between said second substrate and said first substrate.

2. A liquid discharge recording head according to claim 1, wherein said second substrate is molded by the first molding of said bicolor molding, and said insert member is held in a metallic die at the time of molding said second substrate and molded by means of insertion molding.

3. A liquid discharge recording head according to claim 1 or claim 2, wherein the length of said insert member in the arrangement direction of said grooves is larger than the length of said grooves in the arrangement direction of said grooves in the formation area thereof.

4. A liquid discharge recording head according to either claim 1 or claim 2, wherein said insert member is a plate member.

5. A liquid discharge recording head according to claim 4, wherein said insert member is provided with a bending portion to be folded in the arrangement direction of said grooves.

6. A liquid discharge recording head according to claim 4, wherein said insert member is provided with a bead portion formed in the arrangement direction of said grooves.

7. A liquid discharge recording head according to either claim 1 or claim 2, wherein said insert member is arranged in the vicinity of the area having said grooves formed therefor.

8. A liquid discharge recording head according to either claim 1 or claim 2, wherein said insert member is provided with an irregular array formed therefor.

9. A liquid discharge recording head according to either claim 1 or claim 2, wherein said insert member is provided with a tapered hole.

10. A liquid discharge recording head according to either claim 1 or claim 2, wherein said insert member is formed by metal.

11. A liquid discharge recording head according to either claim 1 or claim 2, wherein said insert member is formed by polymeric material having a filler filled therein.

* * * * *